United States Patent [19]

Hoffman et al.

[11] Patent Number: 4,624,120

[45] Date of Patent: Nov. 25, 1986

[54] KEY-OPERATED, EXIT ALARM, SWITCH CAM ASSEMBLY AND MODIFICATION KIT AND MODIFICATION METHOD FOR SWITCH CAM ASSEMBLIES

[75] Inventors: Herbert W. Hoffman, New Palestine; Richard B. Cohrs; William P. Dye, both of Indianapolis, all of Ind.

[73] Assignee: Van Duprin, Inc., Indianapolis, Ind.

[21] Appl. No.: 777,359

[22] Filed: Sep. 18, 1985

[51] Int. Cl.[4] ..... E05B 17/04

[52] U.S. Cl. ..... 70/380; 70/DIG. 49

[58] Field of Search ..... 70/380, DIG. 49, 379 R, 70/379 A, 431, 432, 439, 441; 200/61.64, 61.67; 340/542

[56] References Cited

U.S. PATENT DOCUMENTS 3,174,003 3/1965 Armstrong ..... 340/542

FOREIGN PATENT DOCUMENTS 739206 6/1980 U.S.S.R. ..... 70/DIG. 49

*Primary Examiner*—Robert L. Wolfe

*Attorney, Agent, or Firm*—B. J. Murphy

[57] ABSTRACT

The assembly, in a first embodiment thereof, comprises an annular cam retainer which rotatably journalled on the mortise cylinder of an exit alarm unit, and has a limb disposed for movement by the tailpiece of the mortise cylinder for engagement with a bearing surface on the rotary, switch cam of the assembly. The cam retainer retains the rotary, switch cam in an alarm-silenced position while the key may be rotated in its key cylinder to a disengageable position and removed. The modification kit comprises a cam retainer (i.e., an unthreaded annulus, in one embodiment) required for modifying a key-operated, exit alarm, switch cam assembly to enable removal of the key with the alarm in a silenced position as aforesaid. The modification method sets forth the precedural steps in retrofitting a switch cam assembly with such a modification kit.

17 Claims, 7 Drawing Figures

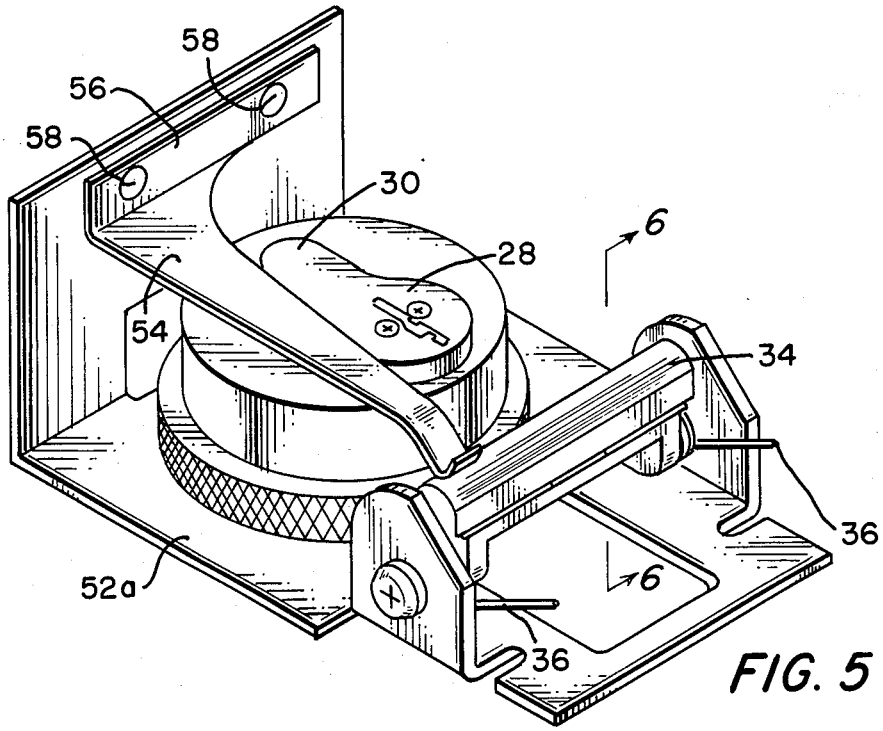
FIG. 5
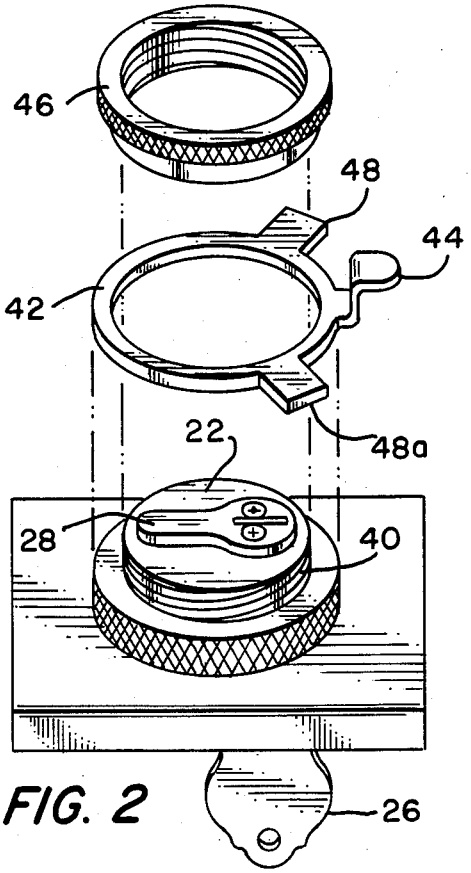
FIG. 2
FIG. 6
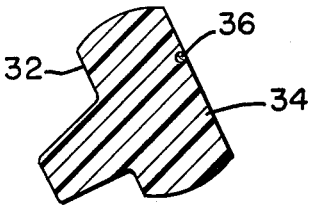
FIG. 6A
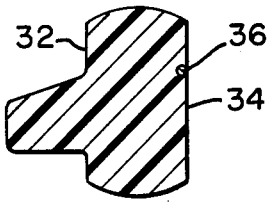

KEY-OPERATED, EXIT ALARM, SWITCH CAM ASSEMBLY AND MODIFICATION KIT AND MODIFICATION METHOD FOR SWITCH CAM ASSEMBLIES

This invention pertains to exit alarm apparatus and in particular to such apparatus as is key-operated, and ordinarily requires the key to remain disengageable therefrom whenever the alarm is silenced.

Exit alarm apparatus and devices are employed, commonly, with touch bar-type mechanisms for door exit latches, for purposes of safety and/or security. Typically, they comprise devices for emitting audible and/or visual alarms to signify that the door, ordinarily to be used only in case of emergencies, is being broached. Frequently, however, it is necessary, for bringing supplies into a building, for cleaning purposes or whatever, that such an exit-alarmed door to be opened, and perhaps opened for an extended period of time, without having the alarm sound. For the purpose, a key-operated alarm silencer, so to speak, is provided. The latter receives a key in order to rotate a tailpiece which disposes a switch cam in an alarm-silencing disposition. However, it is then not possible to remove the key. That is a problem, or has been, prior to our invention. In prior art devices of this type, it has been necessary to leave the key in the lock all the while that the exit alarm is disposed in a muted or silenced attitude. This is ill advised as it offers the opportunity for an unauthorized person to rotate, remove and retain the key. Consequently, the security and safety of the door shall be compromised, unless the key is returned (without having been replicated) or the lock is changed.

It is an object of this invention, then, to set forth an improved key-operated, exit alarm, switch cam assembly, modification kit, and modification method for state-of-the-art switch cam assemblies, which provide for the selective muting or silencing of the alarm, and removal of the key with the alarm so muted or silenced.

It is particularly an object of this invention to set forth a key-operated, exit alarm, switch cam assembly, having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising a cam retainer, coupled to one of said first and second means, and having means for arrestingly engaging said bearing surface to prevent rotation of said cam from said given disposition to said another, normal disposition; wherein said cam retainer is mounted to said one means and is movable, relative to said one means, between a first attitude in which said bearing surface-engaging means thereof is arrestingly engaged with said bearing surface and a second attitude in which said bearing surface-engaging means is removed from said bearing surface, to allow said cam to rotate from said given disposition to said another, normal disposition; and said tailpiece comprises means for moving said cam retainer from one of said first and second attitudes to the other thereof.

It is also an object of this invention to set forth a modification kit, for a key-operated, exit alarm, switch cam assembly, such assembly having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising: a cam retainer, for coupling thereof to one of said first and second means, for arrestingly engaging said bearing surface to prevent rotation of said cam from said given disposition to said another, normal disposition; wherein said cam retainer comprises means for mounting thereof to said one means, movably, between a first attitude in which said bearing surface-engaging means thereof is arrestingly engageable with said bearing surface, and a second attitude in which said bearing surface-engaging means is disengageable from said bearing surface, to allow said cam to rotate from said given disposition to said another, normal disposition; said cam retainer has a portion thereof which, upon such an aforesaid mounting of said retainer to said one means, is obstructive of, and, accordingly, engageable by, said tailpiece pursuant to rotation of said tailpiece, and, as a consequence, is displaceably movable, by said tailpiece, from one of said first and second attitudes to the other thereof; and means for fastening thereof to said one means for securing said cam retainer operatively in place.

It is a further object of this invention to disclose a method of modifying a key-operated, exit alarm, switch cam assembly, such assembly having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising the steps of coupling a cam retainer, to one of said first and second means, which retainer has means for arrestingly engaging said bearing surface to prevent rotation of said cam from said given disposition to said another, normal disposition; wherein said coupling step comprises (a) coupling said retainer to said one means for movement thereof, relative to said one means, between a first attitude thereof in which said bearing surface-engaging means thereof is arrestingly engaged with said bearing surface, and a second attitude thereof in which said bearing surface-engaging means thereof is disengaged from said bearing surface, and (b) coupling to said one means, as aforesaid, such a cam retainer which further has a portion thereof which, as a result of movable coupling thereof to said one means, is obstructive of, and, accordingly, engageable by, said tailpiece, pursuant to rotation of said tailpiece and, as a consequence is moved by said tailpiece from one of said first and second attitudes to the other thereof; and securing said cam retainer, movably disposed as aforesaid, to said one means.

Further objects of this invention, as well as the novel features thereof, will become more apparent by reference to the following description, taken in conjunction to the accompanying figures, in which:

FIG. 2 is an isometric exploded view showing a portion of the platform, the key, the mortise cylinder, the cam retainer, and retainer nut, according to the first embodiment of the invention.

FIG. 5 is an isometric view of an alternative embodiment of the invention;

FIG. 6 is a cross-sectional view of the switch cam, according to either of the embodiments, taken along section 6—6 of FIG. 5, showing the switch cam in its normally-biased disposition; and FIG. 6A is a view like that of FIG. 6, showing the switch cam in its alarm muting or silenced disposition.

Figure 1:
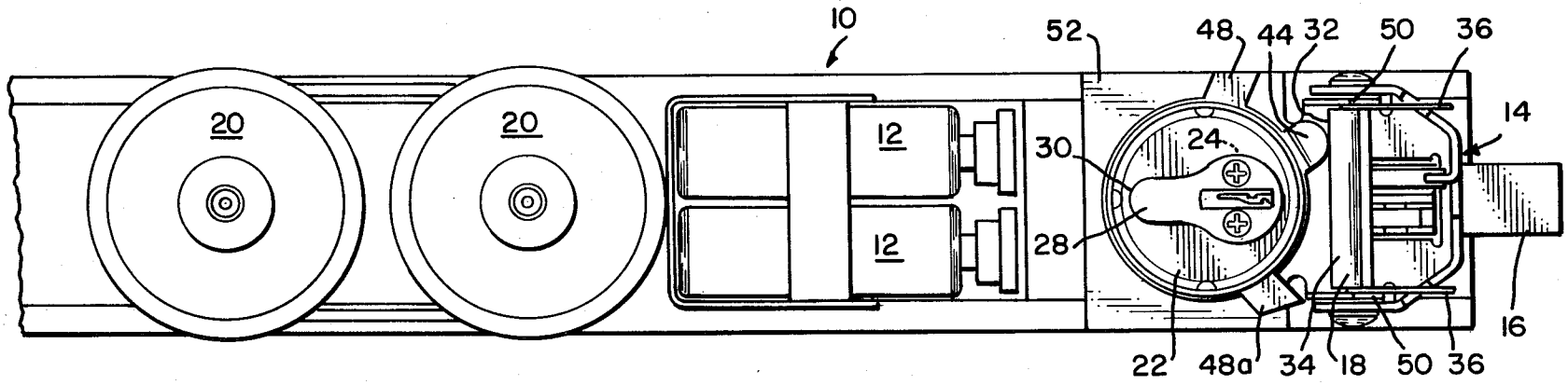
FIG. 1 is a plan view of a portion of a touch-bar type, door exit, latch mechanism, comprising a key-operated, exit alarm apparatus having a switch cam assembly according to a first embodiment of the invention.

The mechanism 10 is available, commercially, for example, from Von Duprin Inc., of 400 West Maryland Street, Indianapolis, Ind. 46225, under part or order numbers 22ALK or 99ALK. In that such devices or mechanisms 10 commercially available, a detailed description of the operation thereof is not necessary here. Suffice it to say that such mechanisms 10 have batteries 12 which provide power to switch contacts 14 which are engaged or disengaged by a touch bar-operated lever 16 and, depending upon the disposition of a switch cam assembly 18, will cause two two horns 20 to sound, and a LED (light emitting diode, not shown) to light.

Typically, the exit alarm mechanism 10 comprises a mortise cylinder 22 having a key cylinder 24 rotatable therein and operated by a key 26 to rotate a tailpiece 28. When the tailpiece 28 is disposed in the attitude shown in FIG. 1, the exit alarm mechanism 10 is triggered. However, when the tailpiece 28 is rotated one hundred and eighty degrees, the outermost end 30 thereof comes into engagement with a bearing surface 32 along a recess in a switch cam 34. Consequently, the end 30 pushes the switch cam 34 contrary to the bias of springs 36 to a disposition or attitude in which the switch contacts 14 are unable to sound the horns 20 or illuminate the LED. However, the key 26, then, is held irremovably within the key cylinder 24, and cannot be removed without setting the exit alarm mechanism 10 back to its triggered disposition. Such is the nature of the prior art exit alarm mechanisms and switch cam assemblies.

Figure 4:
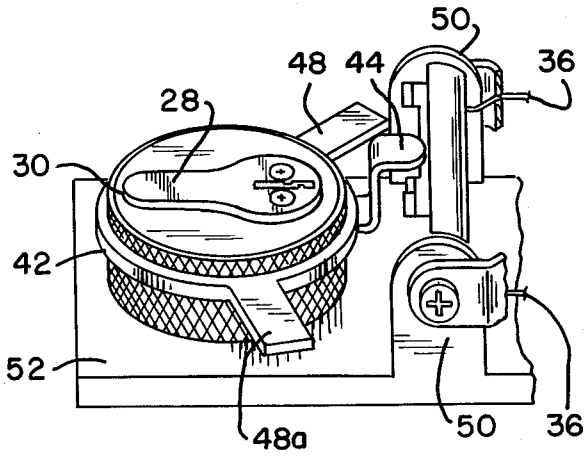
FIGS. 3 and 4 show the novel switch cam assembly in an exit alarm triggered disposition and in a muted or silenced disposition, respectively.

According to the invention, the mortise cylinder 22 outer, threaded surface 40 receives an annular cam retainer 42. The latter has a projecting limb 44 somewhat dog-legged in shape. Retainer 42 is unthreaded, and is simply freely, rotatably journalled on surface 40. It is held in place by means of an internally-threaded cam retainer nut 46. With the nut 46 threaded onto the cylinder 22, and the retainer 42 thereunder, the key cylinder 24 is freely rotatable, and the tailpiece 28 is not obstructed until it slues through an arc in a clockwise direction (as viewed in FIG. 1), which brings it into engagement with the projecting limb 44 of the retainer 42. The tailpiece 28 forces the limb 44 against the bearing surface 32 of the switch cam 34, and pushes the switch cam into its silenced position. This positioning of the limb 44 and switch cam 34 is shown in FIG. 4. The limb 44 of the cam retainer 42 remains so disposed, and therefore the key cylinder 24 can be rotated again back to its original (i.e., FIG. 1) position, and the key can be removed. The exit alarm is silenced for any chosen period of time (i.e., indefinitely), and for purposes of safety and/or security, the key 26 is removable.

Figure 3:
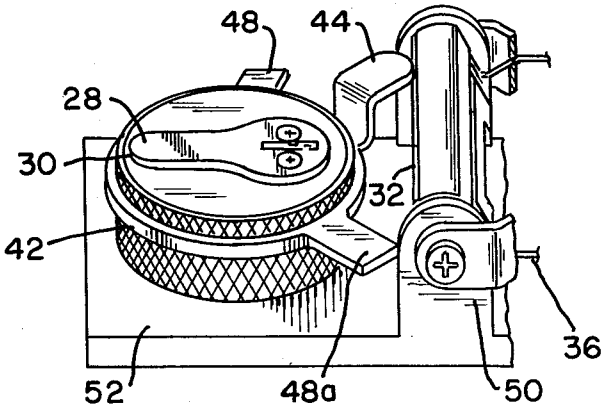

It is probably readily appreciated that all one needs to do, to return the exit alarm mechanism 10 to its triggered disposition, is to move the limb 44 of the cam retainer 42 out of engagement with the bearing surface 32. To do so it is only necessary to reinsert the key 26 and turn the tailpiece 28 again, now in a counter-clockwise direction, until it engages the limb 44 once more and displaces it from the bearing surface 32. In the latter circumstance, then, the switch cam 34 will be free of the retainer 42 and can respond to the bias of springs 36 to resume its normal, triggered position (this position is shown in FIG. 3). Then the tailpiece 28 can be rotated again to its FIG. 1 orientation, so that the key 26 can be removed, and the exit alarm mechanism 10 can be left triggered.

Cam retainer 42 has a pair of other, second and third limbs 48 and **48*a* which project directly outwardly therefrom. Limbs 48 and 48*a* are simply for restricting the rotation of the retainer 42. The switch cam 34 is rotatably mounted in supports 50 which rise from the platform 52. When the tailpiece 28 forces the limb 44 against the bearing surface 32 (to tilt or rotate the switch cam 34 to a silencing position), limb 48 closes upon one of the supports 50 to stop any further rotation of the retainer 42 than that which is needed for the aforesaid purpose. When the tailpiece displaces the limb 44 away from the switch cam 34 the limb 48*a* closes upon the other support 50** to stop further rotation, again to delimit such rotation to only what is necessary.

FIG. 5 shows an alternative embodiment of the invention in which the cam retainer 54 comprises a elongated resilient arm mounted at only one end 56 thereof, by rivets 58, to the platform **52*a*. In this disposition the outermost end of the retainer 54 is resiliently engaged with the top of the switch cam 34. When the tailpiece 28 is rotated in the clockwise direction, it comes into engagement with the bearing surface 32 of the switch cam 34, and forces the latter, against the bias of the springs 36 to its disarmed or silenced position. In so doing, it allows the outermost end of the resilient cam retainer 54 to drop into the recess and abut the bearing surface 32. Then the tailpiece 28 can be rotated again in the counter-clockwise direction and, with the retainer 54 securely abutting the bearing surface 32, i.e., holding the switch cam 34 in the silenced position, the key 26** may be removed.

To return the embodiment of FIG. 5 to its triggered attitude, again one need only return the key 26 to the key cylinder 24 and rotate the tailpiece 28 clockwise. In this circumstance, the outmost end 30 of the tailpiece 28 will slue under the arm of the cam retainer 54 and lift it out of the recess of the switch cam 34 away from the bearing surface 32. Accordingly, biased by the springs 36, the switch cam 34 returns to its biased, triggered attitude, as shown in FIGS. 6 and 3. Then the tailpiece 28 may be rotated again to the position shown in FIG. 5 for the removal of the key 26, and the switch cam 34 shall have been returned to its armed or triggered attitude with the key 26 removed therefrom. The tailpiece 28 lifts the cam retainer 54, in this embodiment, because the retainer, its resilient arm, is deformed intermediate its length to dispose a portion thereof intrusively into the plane through which the tailpiece 28 slues. A portion of the retainer obstructs, and is elevated by, the tailpiece 28.

Of course, there are switch cam assemblies in key-operated, exit alarm units, of the key-retaining types, already in use nationwide and worldwide. However, our invention lends itself to retrofitting of such units. It is only necessary to employ a modification kit, comprising a cam retainer 42 and nut 46, to modify such in-use assemblies. In the alternative, one may modify such assemblies with a kit comprising a cam retainer 54 and rivets 58 (or bolts). Retainer 54, it will be understood only need to be fastened to the platform 52*a*, as shown in FIG. 5, so that (a) a portion thereof will obstruct, and be lifted by the tailpiece 28, and (b) the furthermost end thereof will resiliently engage and abut the bearing surface 32. As for retainer 42 and nut 46, modification therewith is most simple. The surface 40 of the mortise cylinder 22 has an exposed threaded length, and the latter readily receives the annular retainer 42 thereon for journalling, and the nut 46 threadedly engages the surface 40 to keep the retainer 42 in place.

While we have described our invention in connection with specific embodiments thereof, it is to be clearly understood that this is done only by way of example and not as a limitation to the scope of our invention as set forth in the objects thereof and in the appended claims.

We claim:

1. A key-operated, exit alarm, switch cam assembly having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising:

a cam retainer, coupled to one of said first and second means, and having means for arrestingly engaging said bearing surface to prevent rotation of said cam from said given disposition to said another, normal disposition; wherein said cam retainer is mounted to said one means and is movable, relative to said one means, between a first attitude in which said bearing surface-engaging means thereof is arrestingly engaged with said bearing surface, and a second attitude in which said bearing surface-engaging means is removed from said bearing surface, to allow said cam to rotate from said given disposition to said another, normal disposition; and said tailpiece comprises means for moving said cam retainer from one of said first and second attitudes to the other thereof.

2. An exit alarm, switch cam assembly, according to claim 1, wherein:

said cam retainer is rotatably journalled on said cylinder.

3. An exit, alarm switch cam assembly, according to claim 1, wherein:

said cam retainer comprises an annulus; and said annulus is rotatably journalled on said cylinder.

4. An exit alarm, switch cam assembly, according to claim 2, wherein:

said cam retainer has a limb, defining said bearing surface-engaging means thereof, which traverses said plane; and said tailpiece comprises means which, upon rotation through said plane, engages said limb and moves the latter into such arresting engagement with said bearing surface on said cam.

5. An exit alarm, switch cam assembly, according to claim 2, wherein:

said cam retainer has a first limb, defining said bearing surface-engaging means thereof, which traverses said plane; further including supports extending from said platform for mounting of said switch cam; and wherein said cam retainer has second and third limbs, projecting therefrom, which close against said supports, with rotation of said cam retainer on said cylinder, to limit such cam rotation to a narrow arc.

6. An exit alarm, switch cam assembly, according to claim 1, wherein:

said cam retainer comprises a resilient, elongated arm; and said arm is secured, at only one end thereof, to said platform;

said arm extends from said one end, cantilevered, to said switch cam; and the other, opposite end of said arm is resiliently constrained against said switch cam, and is movable relative to said switch cam and said platform.

7. An exit alarm, switch cam assembly, according to claim 6, wherein:

said tailpiece is rotatable through a given, arcuate continuum;

said arm has a portion thereof which intrudes into said continuum for engagement and consequential displacement thereof by said tailpiece; and said tailpiece and said portion comprise means cooperative for causing said opposite end of said arm to move, contrary to the resilient bias of said arm, upon said tailpiece rotating through said continuum and engaging said portion.

8. An exit alarm, switch cam assembly, according to claim 6, wherein:

said opposite end of said arm is set against said bearing surface in said first attitude thereof, and displaced from said bearing surface in said second attitude thereof.

9. An exit alarm, switch cam assembly, according to claim 8, wherein:

said opposite end of said arm is surmountingly engaged with said switch cam, in said second attitude thereof; and said opposite end of said arm is in an abutting engagement with said switch cam, in said first attitude thereof.

10. A modification kit, for a key-operated, exit alarm, switch cam assembly, such assembly having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising:

a cam retainer, for coupling thereof to one of said first and second means, for arrestingly engaging said bearing surface to prevent rotation of said cam from said given disposition to said another, normal disposition; wherein said cam retainer comprises means for mounting thereof to said one means, movably, between a first attitude in which said bearing surface-engaging means thereof is arrestingly engageable with said bearing surface and a second attitude in which said bearing surface-engaging means is disengageable from said bearing surface, to allow said cam to rotate from said given disposition to said another, normal disposition;

said cam retainer has a portion thereof which, upon such an aforesaid mounting of said retainer to said one means, is obstructive of, and, accordingly, engageable by, said tailpiece pursuant to rotation of said tailpiece, and, as a consequence, is displaceably movable, by said tailpiece, from one of said first and second attitudes to the other thereof; and means for fastening thereof to said one means for securing said cam retainer operatively in place.

11. A modification kit, according to claim 10 wherein:

said cam retainer comprises means accommodating its rotatable journalling on said cylinder.

12. A modification kit, according to claim 10 wherein:

said cam retainer comprises an annulus.

13. A modification kit, according to claim 11, wherein:

said cam retainer has a limb which defines said bearing surface-engaging means thereof.

14. A modification kit, according to claim 10, wherein:

said cam retainer comprises a resilient, elongated arm; and said arm has a means for securing it in place from only one end thereof.

15. A method of modifying a key-operated, exit alarm, switch cam assembly, such assembly having (a) first means defining a platform; (b) a spring-biased, rotary, switch cam, having a bearing surface formed thereon, mounted on said platform for rotation between a given, alarm-silenced disposition, and another, normal, alarm-triggered disposition; and (c) second means defining a key-receiving, mortise cylinder having a tailpiece rotatable through a given plane, for engaging said bearing surface and rotating said cam to said given, alarm-silenced disposition; comprising the steps of:

coupling a cam retainer, to one of said first and second means, which retainer has means for arrestingly engaging said bearing surface to prevent rotation of said cam from said given disposition to said another, normal disposition; wherein said coupling step comprises (a) coupling said retainer to said one means for movement thereof, relative to said one means, between a first attitude thereof in which said bearing surface-engaging means thereof is arrestingly engaged with said bearing surface, and a second attitude thereof in which said bearing surface-engaging means thereof is disengaged from said bearing surface, and (b) coupling to said one means, as aforesaid, such a cam retainer which further has a portion thereof which, as a result of movable coupling thereof to said one means, is obstructive of, and, accordingly, engageable by, said tailpiece, pursuant to rotation of said tailpiece and, as a consequence is moved by said tailpiece from one of said first and second attitudes to the other thereof; and securing said cam retainer, movably disposed as aforesaid, to said one means.

16. A method, according to claim 15, wherein:

said step of coupling a cam retainer to said one means comprises providing an annular cam retainer, and rotatably journalling said annular cam retainer on said mortise cylinder.

17. A method, according to claim 15, wherein:

said step of coupling a cam retainer to said one means comprises providing a resilient, elongated arm, and securing said arm, from only one end thereof, to said platform.

* * * * *